United States Patent [19]

Craine et al.

[11] Patent Number: 4,543,545

[45] Date of Patent: Sep. 24, 1985

[54] MICROWAVE RADIO FREQUENCY POWER DIVIDER/COMBINER

[75] Inventors: Richard W. Craine, Nutley; Joseph P. Drabick, Hasbrouck Heights, both of N.J.

[73] Assignee: ITT Corporation, New York, N.Y.

[21] Appl. No.: 589,794

[22] Filed: Mar. 15, 1984

[51] Int. Cl.[4] ..... H01P 5/12

[52] U.S. Cl. ..... 333/128; 333/33

[58] Field of Search ..... 333/104, 124, 125, 127, 333/128

[56] References Cited

U.S. PATENT DOCUMENTS

| | | | |
|---|---|---|---|
| 4,254,386 | 3/1981 | Nemot et al. | 333/128 |
| 4,328,471 | 5/1982 | Quine | 333/128 |
| 4,463,326 | 7/1984 | Hom | 333/128 |

*Primary Examiner*—Paul Gensler

*Attorney, Agent, or Firm*—John T. O'Halloran; Robert P. Seitter

[57] ABSTRACT

The microwave radio frequency power divider/combiner comprises a signal input/output matching network coupled between a signal input/output and a central point of the power divider/combiner. M impedance transformer sections are connected in parallel to the central point and radiate outwardly therefrom with each of the M transformer sections having a first predetermined length, where M is integer greater than one. M pairs of impedance transformers sections are provided with each pair being coupled to an end of a different one of the M transformer sections remote from the central point with each of the transformer sections of the M pairs of transformers sections having the first predetermined length. N output/input ports are each coupled to an end of a different one of the transformer sections of the M pairs of transformer sections remote from the M transformer sections. Each of the N ports are matched to a given impedance and N is equal to 2M. 2N isolation networks include 2N termination impedances each having one terminal thereof connected to ground. The other terminal of each of a given N of the 2N termination impedances are coupled by a different one of first N impedance transformer sections to the N ports. The other terminal of each of the remaining N of the 2N termination impedances are connected by a different one of second N impedance transformer sections to the end of the N transformer sections remote from the central point with each of the first and second N transformer sections having the first predetermined length. N transmission line sections each having a second predetermined length different than the first predetermined length interconnect different adjacent ones of the 2N isolation networks in pairs.

29 Claims, 8 Drawing Figures

MICROWAVE RADIO FREQUENCY POWER DIVIDER/COMBINER

BACKGROUND OF THE INVENTION

The present invention relates to power divider/combiners and more particularly to improved microwave radio frequency power divider/combiners.

The in-line, or Wilkinson-type power divider/combiner has proved very useful for in-phase, equal or unequal power division and combining for applications having moderate power levels or a frequency range where the series resistors can be made sufficiently large to dissipate reasonable power levels. The design criteria and characteristics have been well documented, and because of its electrical and mechanical symmetry, its performance over moderate bandwidths has been superior to other types of couplers, such as rat races and branch arm dividers. At higher frequencies or higher power levels, however, there has been great difficulty in building extremely accurate in-phase high power power divider/combiners because of the physical limitations of the resistors needed for the Wilkinson circuit. These resistors must be physically small and it is difficult to heat sink them because of the additional shunt capacity which has the effect of degrading the performance. In 1975, Ulrich H. Gysel published a paper entitled "A New N-Way Power Divider/Combiner Suitable For High Power Applications", 1975 IEEE-MTTS, Int'l. M. W. Symposium Digest, pages 116–118. While the Gysel network or power divider/combiner does provide a higher power solution for the Wilkinson-type power divider/combiner, the Gysel network can not be realized in a single planar design for N greater than two.

SUMMARY OF THE INVENTION

An object of the present invention is to provide an improved power divider/combiner of the Gysel-type which enables realization of a network in a single planar arrangement where N is greater than two.

Another object of the present invention is to provide a microwave radio frequency power divider/combiner which is an improvement over the Gysel-type power divider/combiner.

A feature of the present invention is the provision of a microwave radio frequency power divider/combiner comprising: a single input/output matching network coupled between a signal input/output and a central point of the divider/combiner; M impedance transformer sections connected in parallel to the central point and radiating outwardly therefrom, each of the M transformer sections having a first predetermined length, where M is an integer greater than one; M pairs of impedance transformer sections, each pair of the M pairs of transformer sections being coupled to an end of a different one of the M transformer sections remote from the central point, each transformer section of the M pairs of transformer sections having the first predetermined length; N output/input ports each coupled to an end of a different one of the transformers sections of the M pairs of transformer sections remote from the M transformer sections, each of the N ports being matched to a given impedance, where N is equal to 2M; 2N isolation networks including 2N termination impedances each having one terminal thereof connected to ground, the other terminal of each of a given N of the 2N termination impedances being connected by a different one of first N impedance transformer sections to the N ports, and the other terminal of each of the remaining N of the 2N termination impedances being connected by a different one of second N impedances transformer sections to the end of the M transformer sections remote from the central point, each of the first and second N transformer sections having the first predetermined length; and N transmission line sections each having a second predetermined length different than the first predetermined length, each of the N transmission line sections interconnecting different adjacent ones of the 2N isolation networks in pairs.

Another feature of the present invention is the provision of at least the M impedance transformer sections, the M pairs of impedance transformer sections and the N transmission line sections being provided on a single planar surface of a selected one of a strip line arrangement and a microstrip arrangement.

A further feature of the present invention is the provision of N additional isolation networks including N additional termination impedances each having one terminal thereof connected to ground with the other terminal of each of the N additional termination impedances being connected by a different one of third N impedance transformer sections to the N ports; and N additional transformer line sections each having the second predetermined length and interconnecting different adjacent ones of the additional isolation networks in pairs.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
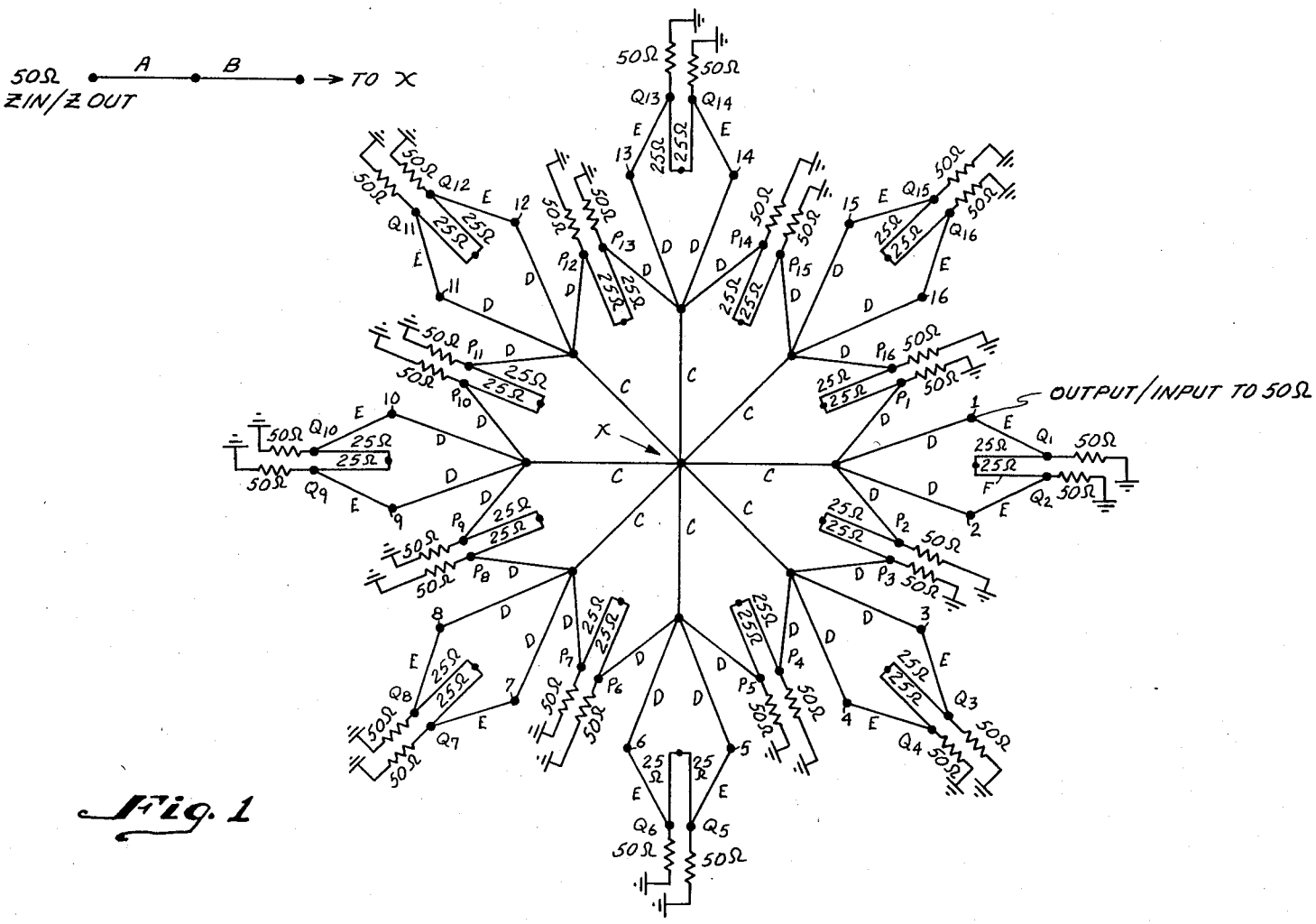
FIG. 1 is a schematic diagram of a 16-way power divider/combiner in accordance with the principles of the present invention.

Except for the input/output matching network which must be fed through the center of the microwave radio frequency power divider/combiner of the present invention, the network described herein may be realized on a single planar strip line or microstrip device or arrangement thereby greatly simplifying its construction.

The microwave radio frequency power divider/combiner of the present application comprises quarter wavelength impedance matching sections and terminating resistors which act as a multiport hybrid. When operated as a N port divider, no power is dissipated in the internal resistor terminations. When operating as a power combiner, only signals which are unbalanced (either in amplitude or phase) are dissipated in the internal resistor networks.

The signal input/output matching network coupled between a signal input/output matched to 50 ohms and a central point x of the power divider/combiner includes coaxial or strip line quarter wavelength transformer sections A and B which feed coaxially into the central point x of the divider/combiner. Eight impedance transformer sections C are connected in parallel to point x and radiate outwardly making an even mode impedance of 65.735/8=8.2169 ohms. Each of the impedance transformer sections C are divided into two impedance transformer sections D of 70.170 ohms. The 16 output/input ports numbered 1 through 16 in FIG. 1 are matched to 5 ohms impedance.

Isolation is provided by interconnected 50 ohm terminations connected to points Q1–Q16 and P1–P16. One terminal of each of these 50 ohm terminations is connected to ground. The other terminal of the 50 ohm terminations connected to points P1–P16 are connected by quarter wavelength impedance matching transformer sections D to the end of the transformer section C remote from the central point X. The other terminal of the 50 ohm terminations connected to the points Q1–Q16 are connected by quarter wavelength impedance matching transformer sections E to the output-/input ports 1–16. Each pair of adjacent ones of the 50 ohm terminations are interconnected by a half wavelength of transmission line, such as transmission line F interconnecting points Q1 and Q2, so that the termination impedances are connected in pairs as illustrated.

Figure 2:
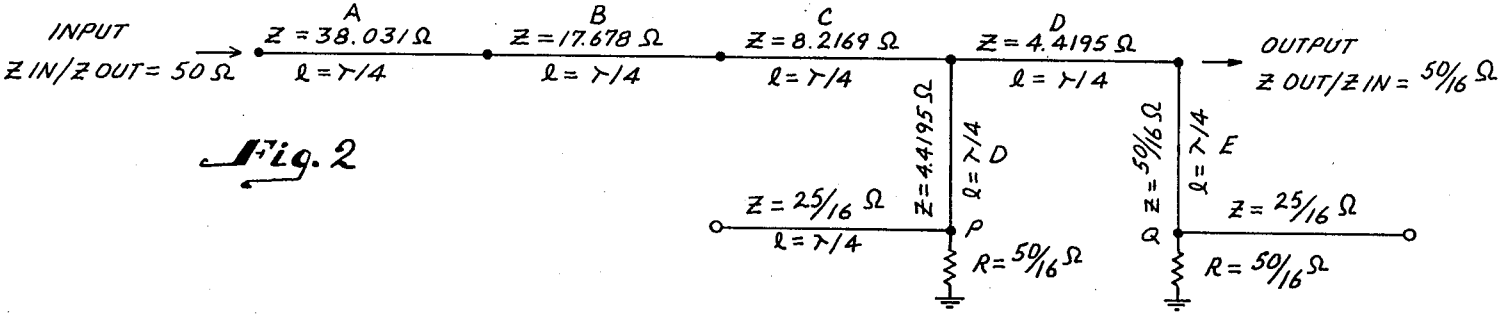
FIG. 2 is an even mode representation of the power divider/combiner of FIG. 1.

The impedance transformer sections have impedance values as follows:

$Z_A$=38.031 ohms
$Z_B$=17.678 ohms
$Z_C$=65.735 ohms
$Z_D$=70.710 ohms
$Z_E$=50.000 ohms The even mode representation of the circuit of FIG. 1 is shown in FIG. 2. The termination resistors R appear to be in parallel and appear to have a one-quarter wavelength open circuit stub line connected to points Q and P. This results in a very low reactive impedance in paralled with the termination and prevents signal from being dissipated in the termination when the network is balanced. The impedance transformer sections D which connect to output/input ports 1 through 16 together with the termination connections at points Q1 through Q16 form a variation of the Gysel circuit consisting of eight individual two port divider/combiner networks.

Figure 3:
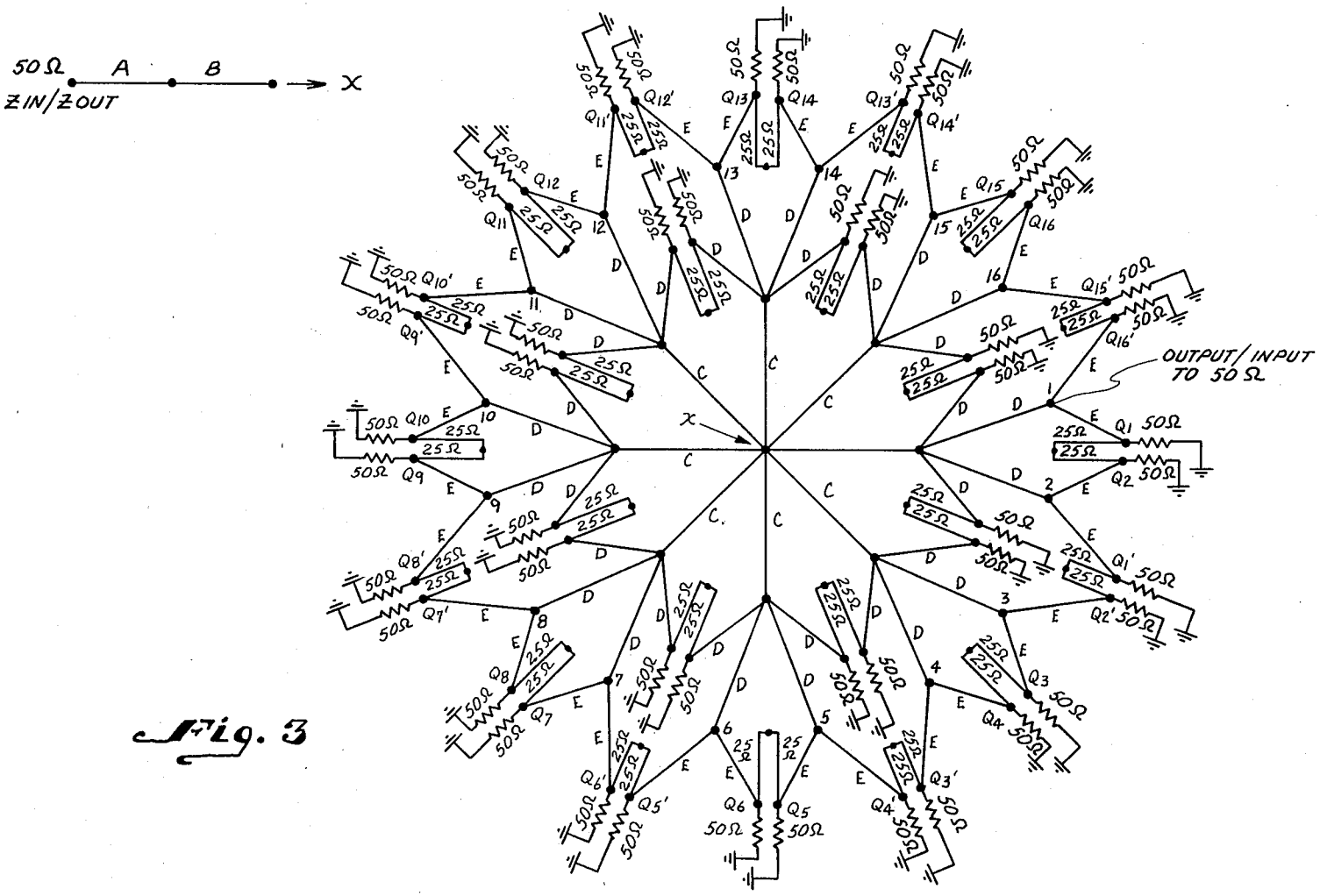
FIG. 3 is a schematic diagram of a second embodiment of a 16-way power divider/combiner in accordance with the principles of the present invention.

Referring to FIG. 3, a variation of FIG. 1 is shown wherein the output/input ports 1–16 have connected thereto additional termination impedances at points Q1'–Q16' by means of additional transmission line sections E with the additional termination impedances being connected in pairs by one-half wavelength transmission line sections, such as transmission line section F' connected between points Q1' and Q2'.

Figure 4:
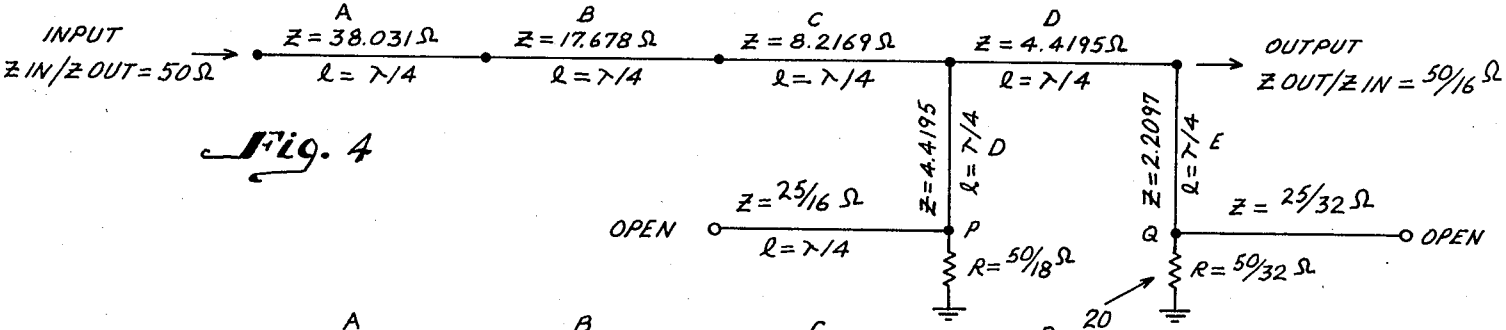
FIG. 4 is an even mode representation of the power divider/combiner of FIG. 3.

The even mode representation of the circuit of FIG. 3 is shown in FIG. 4. Note that the circuit of FIG. 4 is identical to that of FIG. 2 except for the values of the second parallel branch line 20.

When a signal is input to the divider/combiner of FIG. 1, with matched terminations at each of the output/input ports, symmetrical nodes within the device are at equal potential. All equal potential nodes may be joined without changing the operation of the network. When all such nodes have been strapped, including the set of output ports, equivalent circuits may be substituted for the actual network circuits. The resultant equivalent circuit for the divider/combiner of FIG. 1 is the circuit shown in FIG. 2. This network may be analyzed and/or optimized using a "COMPACT" microwave network computer program.

Figure 5:
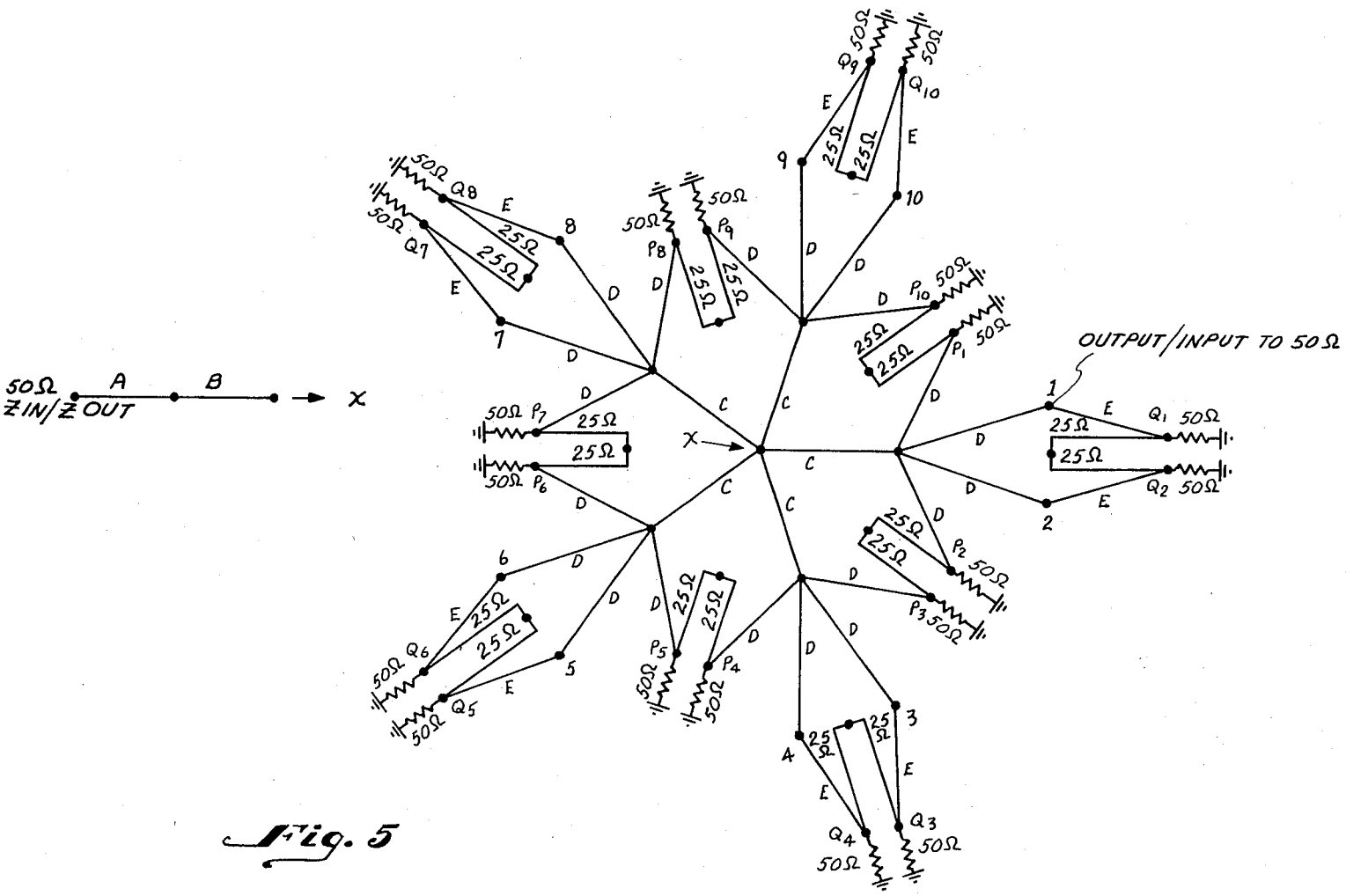
FIG. 5 is a schematic diagram of a 10-way power divider/combiner in accordance with the principles of the present invention.

The impedances of the various impedance transformer sections of the embodiment of FIG. 3 are as follows:

$Z_A$=38.031 ohms
$Z_B$=17.678 ohms
$Z_C$=65.735 ohms
$Z_D$=70.710 ohms
$Z_E$=70.710 ohms Referring to FIG. 5, there is illustrated therein a 10-way power divider/combiner in accordance with the principles of the present invention utilizing an arrangement described hereinabove with respect to FIGS. 1 and 3 having termination impedances connected at points Q1–Q10 and P1–P10 with these termination impedances being coupled in pairs by half wavelength transmission line sections, such as section F connected between points Q1 and Q2. In this arrangement the impedances of the various impedance transformer sections are as follows:

$Z_A$=40.492 ohms
$Z_B$=24.337 ohms
$Z_C$=53.410 ohms
$Z_D$=54.831 ohms
$Z_E$=50.000 ohms In the embodiments of FIGS. 1, 3 and 5 the output-/input ports 1–16 and 1–10 are all matched to a 50 ohm output impedance.

Figure 6:
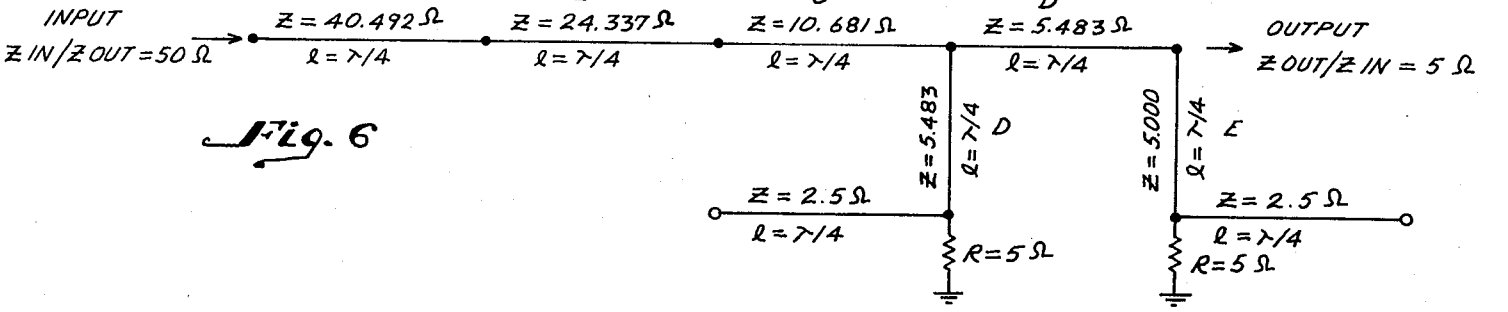
FIG. 6 is an even mode representation of the power divider/combiner of FIG. 5.

FIG. 6 illustrates the even mode representation of the arrangement of FIG. 5 and is similar to that mentioned hereinabove with respect to FIG. 2.

Figure 7:
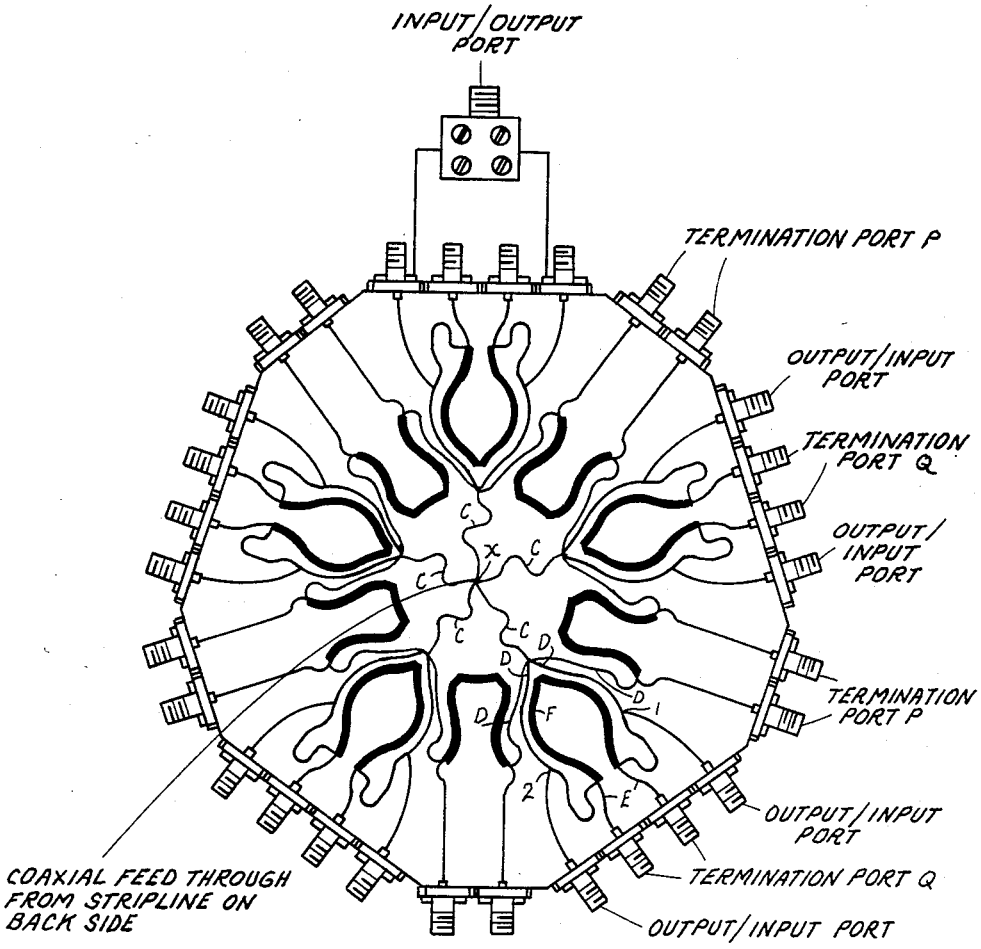
FIG. 7 is a top view of a microstrip realization of the power divider of FIG. 5.
Figure 8:
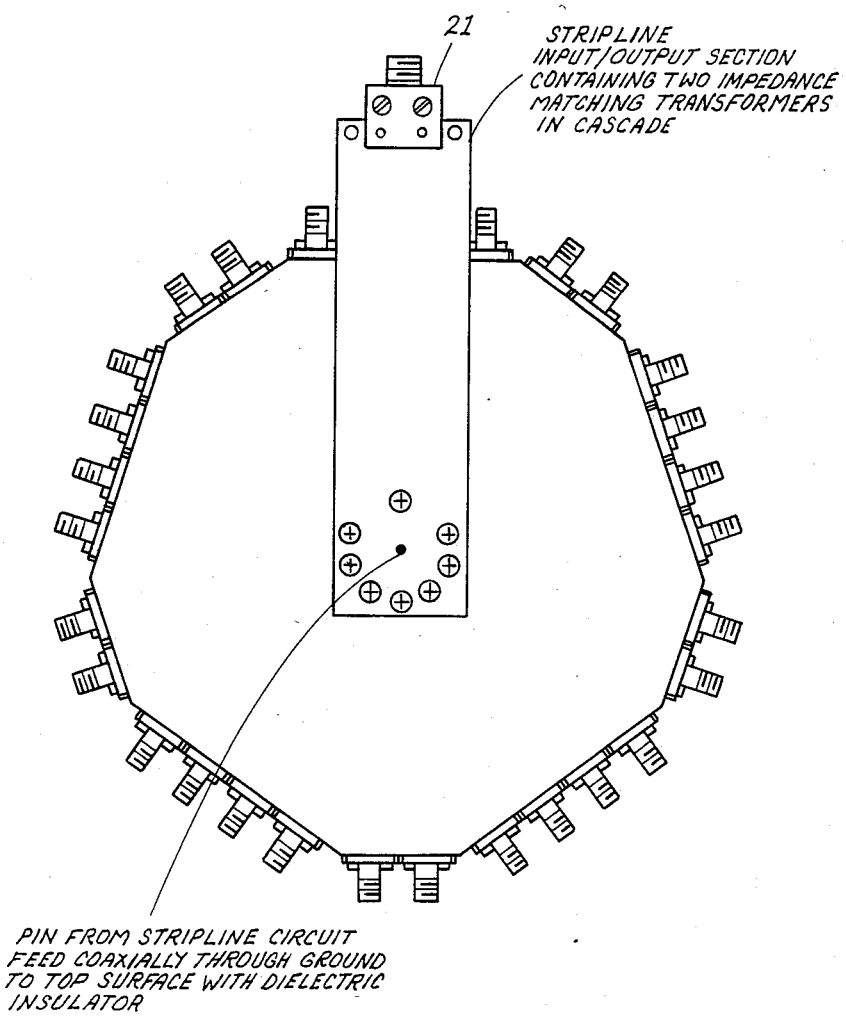
FIG. 8 is a bottom view of the microstrip realization of FIG. 7.

FIGS. 7 and 8 illustrate a microstrip realization of the 10-way power divider/combiner of FIG. 5. The signal input/output matching network is shown at 21 with the feed through from the bottom side of the microstrip arrangement to the upper surface thereof at the point x shown in FIG. 7. The termination ports Q and P connect to the termination impedances which are located externally of the microstrip arrangement.

It should be noted however that the termination impedances could be provided within the microstrip arrangement by forming the termination impedances in the microstrip arrangement itself with one terminal of the termination impedances being connected to the ground plane.

The microstrip arrangement of FIGS. 7 and 8 can easily be modified by one skilled in the art to provide a strip line arrangement equivalent to the microstrip arrangement of FIGS. 7 and 8 by adding the required second ground plane.

While we have described above the principles of our invention in connection with specific apparatus it is to be clearly understood that this description is made only by way of example and not as a limitation to the scope of our invention as set forth in the objects thereof and in the accompanying claims.

We claim:

1. A microwave radio frequency power divider/combiner comprising:

a signal input/output matching network coupled between a signal input/output and a central point of said divider/combiner;

M impedance transformer sections connected in parallel to said central point and radiating outwardly therefrom, each of said M transformer sections having a first predetermined length, where M is an integer greater than one;

M pairs of impedance transformer sections, each pair of said M pairs of transformer sections being coupled to an end of a different one of said M transformer sections remote from said central point, each transformer section of said M pairs of transformer sections having said first predetermined length;

N output/input ports each coupled to an end of a different one of said transformer sections of said M pairs of transformer sections remote from said M transformer sections, each of said N ports being matched to a given impedance, where N is equal to 2M;

2N isolation networks including 2N termination impedances each having one terminal thereof connected to ground, the other terminal of each of a given N of said 2N termination impedances being connected by a different one of first N impedance transformer sections to said N ports, and the other terminal of each of the remaining N of said 2N termination impedances being connected by a different one of second N impedance transformer sections to said end of said M transformer sections remote from said central point, each of said first and second N transformer sections having said first predetermined length; and N transmission line sections each having a second predetermined length different than said first predetermined length, each of said N transmission line sections interconnecting different adjacent ones of said 2N isolation networks in pairs.

2. A power divider/combiner according to claim 1, wherein at least said M impedance transformer sections, said M pairs of impedance transformer sections, and said N transmission line sections are provided on a single planar surface of a selected one of a strip line arrangement and a microstrip arrangement.

3. A power divider/combiner according to claim 2, wherein said input/output matching network includes at least two cascade connected impedance transformer sections each having said first predetermined length formed by a selected one of coaxial transformer sections and strip line transformer sections disposed on a surface of said selected one of said strip line arrangement and said microstrip arrangement parallel to and spaced from said planar surface, one terminal of said two impedance transformer sections extending through said selected one of said strip line arrangement and said microstrip arrangement to said central point.

4. A power divider/combiner according to claim 3, further including

N additional isolation networks including N additional termination impedances each having one terminal thereof connected to ground, the other terminal of each of said N additional impedances being connected by a different one of third N impedances transformer sections to said N ports; and N additional transmission line sections each having said second predetermined length and interconnecting different adjacent ones of said N additional isolation networks in pairs.

5. A power divider/combiner according to claim 4, wherein said first predetermined length equals one-quarter wavelength at an operating frequency of said power divider/combiner.

6. A power divider/combiner according to claim 5, wherein said second predetermined length equals one-half wavelength at an operating frequency of said power divider/combiner.

7. A power divider/combiner according to claim 4, wherein said second predetermined length equals one-half wavelength at an operating frequency of said power divider/combiner.

8. A power divider/combiner according to claim 3, wherein said first predetermined length equals one-quarter wavelength at an operating frequency of said power divider/combiner.

9. A power divider/combiner according to claim 8, wherein said second predetermined length equals one-half wavelength at an operating frequency of said power divider/combiner.

10. A power divider/combiner according to claim 3, wherein said second predetermined length equals one-half wavelength at an operating frequency of said power divider/combiner.

11. A power divider/combiner according to claim 4, wherein said 2N isolation networks and said N additional isolation networks are disposed externally of said selected one of said strip line arrangement and said microstrip arrangement.

12. A power divider/combiner according to claim 4, wherein said 2N isolation networks and said N additional isolation networks are disposed in said selected one of said strip line arrangement and said microstrip arrangement.

13. A power divider/combiner according to claim 3, wherein said 2N isolation networks are disposed externally of said selected one of said strip line arrangement and said microstrip arrangement.

14. A power divider/combiner according to claim 3, wherein said 2N isolation networks are disposed in said selected one of said strip line arrangement and said microstrip arrangement.

15. A power divider/combiner according to claim 1, wherein said input/output matching network includes at least two cascade connected impedance transformer sections each having said first predetermined length.

16. A power divider/combiner according to claim 15, further including

N additional isolation networks including N additional termination impedances each having one terminal thereof connected to ground, the other terminal of each of said N additional impedances being connected by a different one of third N impedances transformer sections to said N ports; and N additional transmission line sections each having said second predetermined length and interconnecting different adjacent ones of said N additional isolation networks in pairs.

17. A power divider/combiner according to claim 16, wherein said first predetermined length equals one-quarter wavelength at an operating frequency of said power divider/combiner.

18. A power divider/combiner according to claim 17, wherein said second predetermined length equals one-half wavelength at an operating frequency of said power divider/combiner.

19. A power divider/combiner according to claim 16, wherein said second predetermined length equals one-half wavelength at an operating frequency of said power divider/combiner.

20. A power divider/combiner according to claim 15, wherein said first predetermined length equals one-quarter wavelength at an operating frequency of said power divider/combiner.

21. A power divider/combiner according to claim 20, wherein said second predetermined length equals one-half wavelength at an operating frequency of said power divider/combiner.

22. A power divider/combiner according to claim 15, wherein said second predetermined length equals one-half wavelength at an operating frequency of said power divider/combiner.

23. A power divider/combiner according to claim 1, further including

N additional isolation networks including N additional termination impedances each having one terminal thereof connected to ground, the other terminal of each of said N additional impedances being connected by a different one of third N impedances transformer sections to said N ports; and N additional transmission line sections each having said second predetermined length and interconnecting different adjacent ones of said N additional isolation networks in pairs.

24. A power divider/combiner according to claim 23, wherein said first predetermined length equals one-quarter wavelength at an operating frequency of said power divider/combiner.

25. A power divider/combiner according to claim 24, wherein said second predetermined length equals one-half wavelength at an operating frequency of said power divider/combiner.

26. A power divider/combiner according to claim 23, wherein said second predetermined length equals one-half wavelength at an operating frequency of said power divider/combiner.

27. A power divider/combiner according to claim 1, wherein said first predetermined length equals one-quarter wavelength at an operating frequency of said power divider/combiner.

28. A power divider/combiner according to claim 27, wherein said second predetermined length equals one-half wavelength at an operating frequency of said power divider/combiner.

29. A power divider/combiner according to claim 1, wherein said second predetermined length equals one-half wavelength at an operating frequency of said power divider/combiner.

* * * * *